US005185933A

United States Patent [19]

Messinger

[11] Patent Number: 5,185,933

[45] Date of Patent: Feb. 16, 1993

[54] SHAVING FOIL

[75] Inventor: Werner Messinger, Kronberg, Fed. Rep. of Germany

[73] Assignee: Braun Aktiengesellschaft, Frankfurt, Fed. Rep. of Germany

[21] Appl. No.: 772,931

[22] Filed: Oct. 8, 1991

[30] Foreign Application Priority Data

Oct. 8, 1990 [DE] Fed. Rep. of Germany ..... 4031871

[51] Int. Cl.[5] ..... B26B 19/04

[52] U.S. Cl. ..... 30/346.51; 30/43.92

[58] Field of Search ..... 30/34.2, 43.92, 346.51, 30/34.05, 43.9

[56] References Cited

U.S. PATENT DOCUMENTS 2,297,915 10/1942 Rand et al. ..... 30/34.2

FOREIGN PATENT DOCUMENTS 1957551 11/1969 Fed. Rep. of Germany .

58-15883 1/1983 Japan .

*Primary Examiner*—Douglas D. Watts

*Attorney, Agent, or Firm*—Fish & Richardson

[57] ABSTRACT

The invention is directed to a shaving foil for a dry shaving apparatus, including a plurality of adjacent polygonal apertures. In the area of the nodal points of intersecting partitions which separate several contiguous apertures, knob-type protuberances are provided on the side of the shaving foil engaging the skin surface.

9 Claims, 5 Drawing Sheets

SHAVING FOIL

This invention relates to a shaving foil for a dry shaving apparatus, including a plurality of adjacent elongate and/or circular and/or polygonal apertures, with knob-type protuberances being provided in the area of partitions separating the apertures on the side engaging the skin surface.

A foil screen for dry shavers is already known (DE OS 1,957,551) which is provided with a plurality of protuberances on the skin engaging surface. The protuberances are hill-shaped and of a sharp-edged, blade-type configuration, being disposed in the peripheral area of the individual aperture provided in the foil screen. They include a portion which is steeply inclined towards the periphery of the apertures and a portion which is inclined at a flat angle to the next aperture. The protuberances are intended to reinforce part of the periphery of the shaving aperture and to act as means for raising the hairs. Considering, however, that the protuberances are steeply inclined towards only one side of the apertures, it follows that the dry shaving apparatus is effective in only one direction, whereby the cutting result of the appliance is severely impaired.

Further, a dry shaving apparatus of the type initially referred to is known (JA OS 58-15883) which is equipped with a shaving foil having multiple adjacent elongate perforations. The individual elongate perforations are arranged in several rows, each row being somewhat offset relative to the adjacent row. A protuberance is provided only between the opposite ends of three contiguous elongate perforations. The protuberances are conically or hemispherically shaped. This is intended to facilitate the beard hair pickup operation. However, since the width of the partitions is greater than the span of the perforations and the individual protuberances are at a relatively large distance to the rims of the perforations, the beard hair pickup operation is not supported in the desired manner. Moreover, in the known arrangement a maximum of three protuberances are grouped around one elongate perforation which is far from being sufficient. In order to ensure sufficient stability of the known shaving foil, such an arrangement of the individual perforations and the protuberances associated therewith requires that the thickness of the foil do not fall below a predetermined value. The known arrangement also has the disadvantage that the overall area of the protuberances is very small in relation to the overall area of the partition.

By contrast, it is an object of the present invention to configure and arrange the individual protuberances provided on the partitions such that a sufficient size of the apertures can be maintained in order to achieve good cutting results while giving an optimally gentle shave. According to the present invention, this object is accomplished in that the protuberances are provided at least in the area of the nodal points of partitions separating several contiguous apertures. For this purpose, the protuberances are advantageously provided on the nodal points and/or reductions of area of the grain of the partition material surrounding the circular and/or polygonal apertures. The protuberances in the area of the nodal points result in an improvement of the bow-wave effect on the skin and enable the beard hairs to be readily received into the foil apertures during shaving. This enables the cutting result and thus the overall shaving performance to be improved.

The shaving performance may also be improved by using the shaving foil as a twin shaving foil for twin cutter heads. In this arrangement, the cutter assemblies may have a diameter of between 8 and 13 mm for optimum shaving performance.

By increasing the height of the partitions in the area of the nodal points or reductions of area of the grain of the partition material separating the circular and/or polygonal apertures, reinforcement of the partitions is accomplished particularly in areas in which the partitions are exposed to continuously varying forces, in particular compressive, tensile or bending forces. As becomes apparent from the path of the lines of force, the forces referred to are at their maximum in the nodal point areas, so that use of the protuberances enables the critical nodal point areas to receive higher forces. Consequently, the use of the protuberances also affords the possibility of reducing both the foil thickness and the partition width, in order to thereby increase the span of the apertures, in which case the span may only be increased to a limit value at which the risk of skin irritation might be present, and/or in order to increase the number of apertures in the perforate field of the foil.

In a further embodiment of the invention, the protuberances are advantageously provided on the points of intersection of intersecting center lines of partitions or apertures, with the partition width being smaller than the span of the apertures.

In another development of the device of the invention, the apertures are polygonal, advantageously hexagonal, and at least one protuberance is provided in each corner area. It is further advantageous that the protuberances are spaced at uniform distances and surround each aperture in a circular pattern. This results in a symmetrical arrangement of the protuberances around each aperture, ensuring at all times a good shaving performance, irrespective of the direction in which the shaver is moved.

It is of particular importance for the present invention that the protuberances are of a height equal to or smaller than the height of the partition.

Finally, in a still further embodiment of the invention, the protuberances are made of the same material as the remaining part of the shaving foil. Moreover, the protuberances may be made of a material other than the remaining part of the shaving foil. This enables the bow-wave effect on the skin to be favorably influenced or optimized in a simple manner.

Overall, owing to the advantageous use of the protuberances or knobs provided on the shaving foil, particularly in the knob or gusset area of the partitions formed by the apertures, not only a good shaving performance is obtained but also the service life of the shaving foil is materially increased, because a high load-bearing capability of the shaving foil is ensured while its high flexibility is maintained. The favorable ratio of aperture size to partition width and the favorable partition height in the knob area have a beneficial effect on the shaving quality in a simple manner.

Details of the present invention will be set out in the subsequent description and the Figures, it being understood that all single features and all combinations of single features are essential to the invention.

An embodiment of the invention will now be described by way of example without being limited to this particular embodiment, reference being had to the accompanying drawings, in which.

Figure 1:
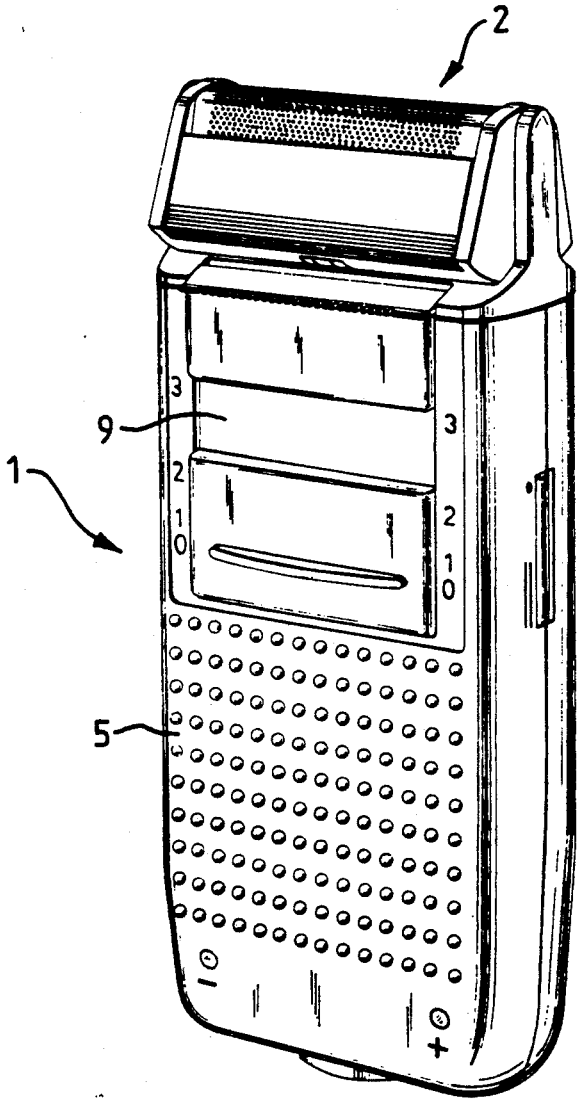
FIG. 1 is a perspective view of a dry shaving apparatus having a movable oscillating head, and of the shaving foil constructed in accordance with the invention.

Referring now to FIG. 1, reference numeral 1 identifies a dry shaving apparatus comprising a housing 5 with an electric motor, not shown in the drawing, for driving a cutter assembly 7. Disposed on the outer panel of the housing 5 is a slide control 9 by means of which the electric motor can be switched on and off. The cutter assembly 7 which is surrounded by a shaving foil 2 is disposed on an oscillating shaft at the upper end of the housing 5.

Figure 2:
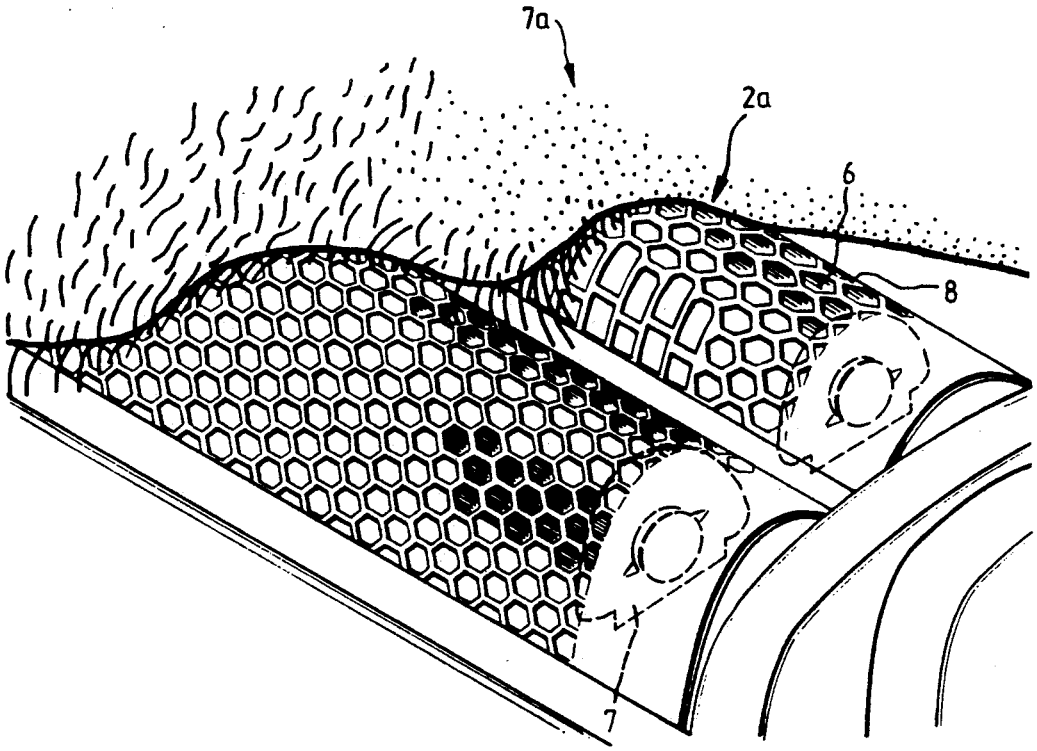
FIG. 2 is a perspective view of an upper portion of the shaving foil showing also the beard hair pickup operation.

The dry shaving apparatus 1 may be equipped with a single cutter assembly as shown in FIG. 1 or with a twin cutter assembly 7*a* as shown in FIG. 2. As becomes clearly apparent from FIG. 2, the two closely adjacent twin shaving foils 2*a* result in an improvement of the bow-wave effect produced on the skin by the twin shaving foil, causing the beard hairs to be raised so that they are capable of being received into the apertures 6 of the twin shaving foil 2*a* with substantially greater ease. In combination with the pivotal shaving head and the twin shaving foil 2*a*, an optimum skin contact is thereby ensured at all times, because the perfect shaving angle will invariably ensue. This results in a close and at the same time gentle shave. The bow-wave effect is further improved by the use of knobs 12, as will be described in more detail in the following.

Figure 4:
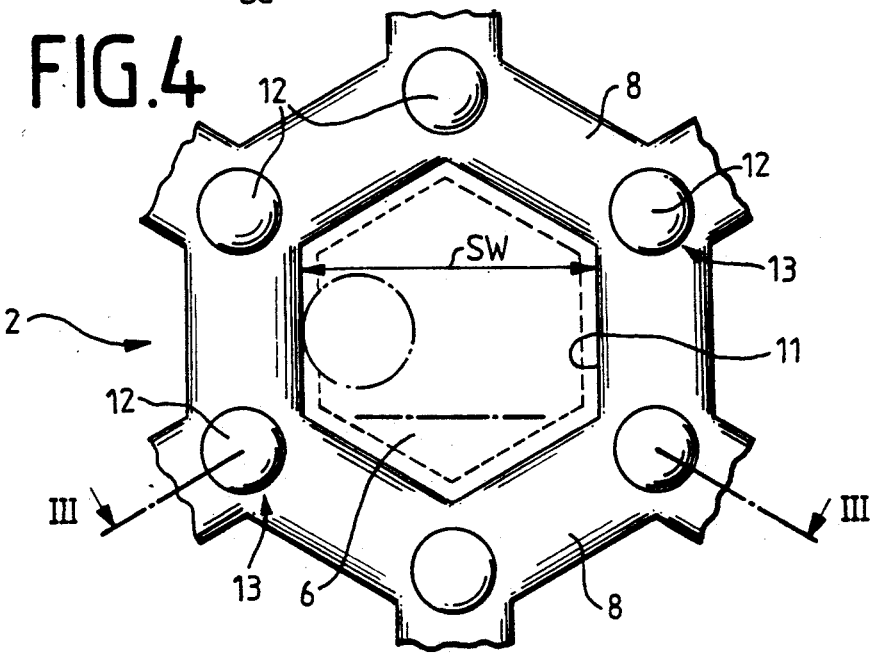
FIG. 4 is a fragmentary view of the shaving foil showing a hexagonal aperture and the knobs disposed in the nodal points of the partitions.
Figure 8:
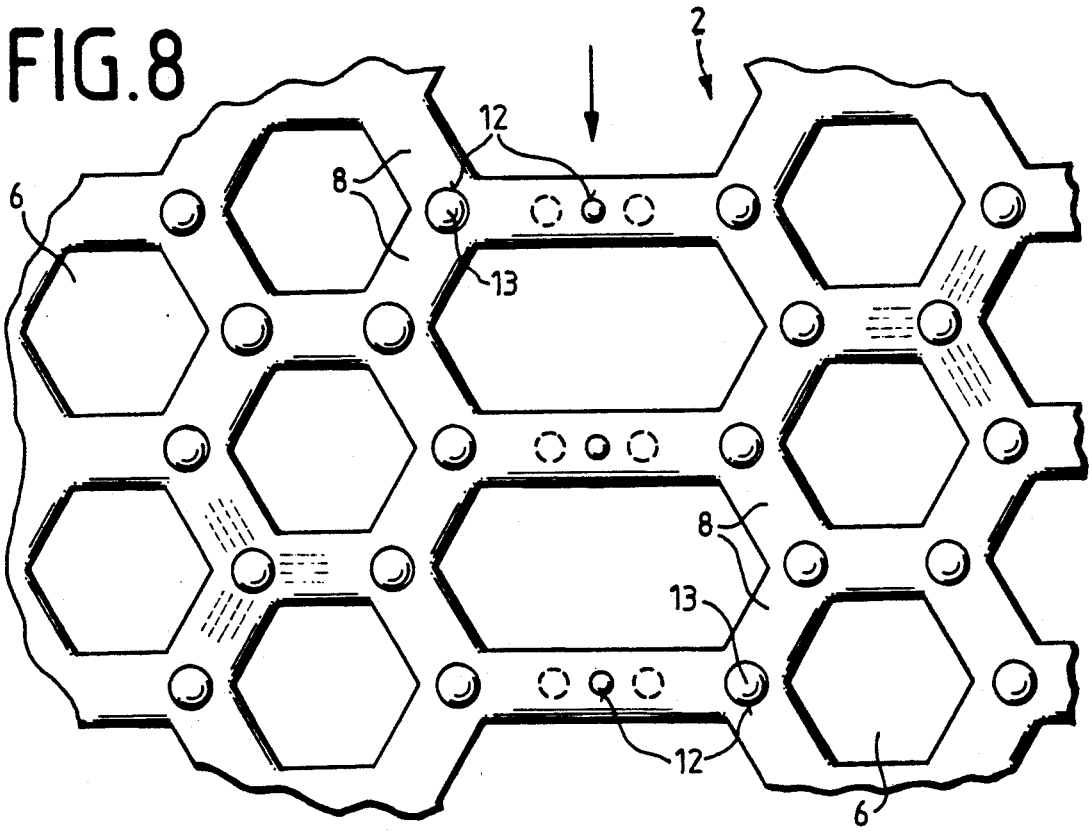
FIG. 8 is a top plan view of the shaving foil showing apertures of different configurations and the knobs provided in the nodal points.

FIG. 8 shows a shaving foil 2 in laid out condition. The shaving foil 2 includes a plurality of adjacent apertures 6 which may be advantageously of a round, oval, elongate or polygonal, in particular, hexagonal shape. In the embodiment of FIGS. 4 and 8, the individual apertures 6 are hexagonal. As a result, the individual apertures 6 are arranged in a honeycomb pattern. The individual apertures 6 are separated by linear partitions 8. It will be understood, however, that the individual partitions 8 may also be of a bent, circular or slightly undulate form.

Advantageously, the ratio of the total area of an aperture 6 to half the total area of the partitions 8 surrounding that aperture is greater than 1. As used in the subsequent formula, V is the ratio quantity, Fö is the total area of an aperture 6, and Fst is half the total area of the partitions surrounding an aperture:

$$V = \frac{F\ddot{o}}{Fst} > 1$$

This results in a relatively large cross-section of passage. Because the shaving performance is composed of the efficiency with which the beard hairs are received into the apertures 6 and the cutting quality, the aperture size alone is not decisive for a good shaving performance.

The larger the radius R (FIG. 7) of the shaving foil 2, the more flexible is the shaving foil 2 and the greater is the ease with which it is capable of engaging the outer contour of the cutter assembly 7 or 7*a*. However, with the radius R increasing, the shaving performance will decrease from a certain point on. For this reason, it is advantageous to have a shaving foil 2 with a relatively small radius R. On the other hand, this results in a more pronounced curvature of the shaving foil 2 and accordingly higher bending stresses to which the shaving foil is exposed, making it necessary for the shaving foil 2 to be dimensioned to a correspondingly greater thickness.

In the use of a knobbed foil, the possibility exists to subject the thinner shaving foil 2 to higher stresses, that is, to bend it more, because the knobs 12 in the area of the nodal points, which is the area of the critical points, function as reinforcements for the foil, so that there is no danger for the shaving foil to break if its thickness is reduced by the amount of the knob height.

Figure 3:
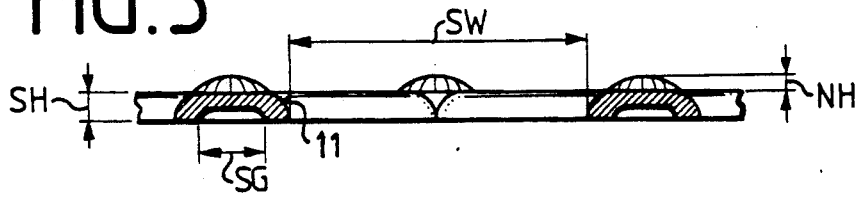
FIG. 3 is a sectional view of the shaving foil taken along the line III—III of FIG. 4.
Figure 6:
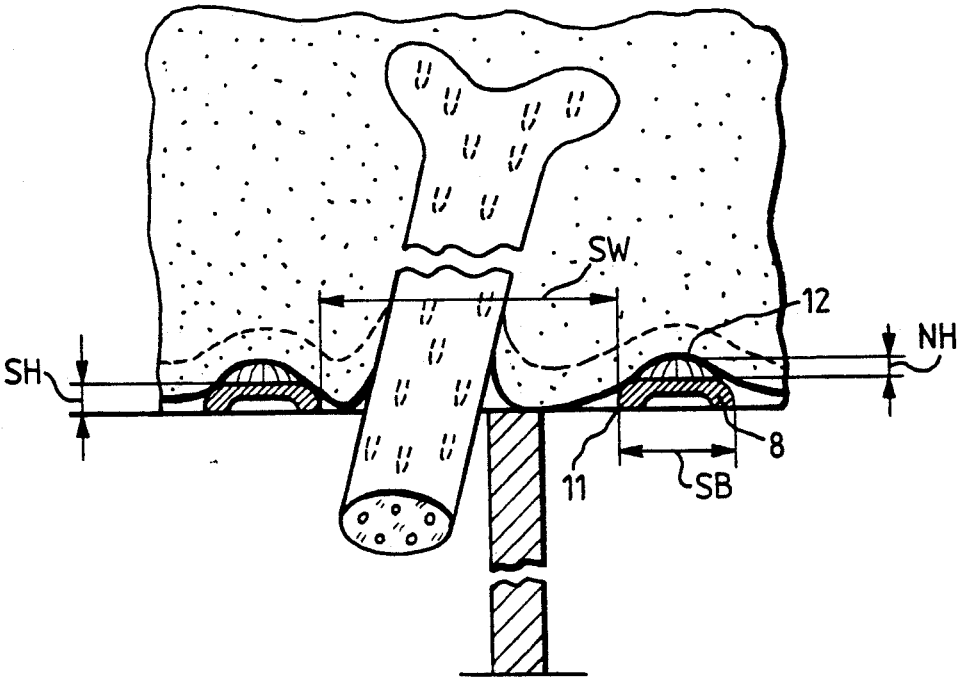
FIG. 6 is a cross-sectional view of the upper part of the shaving foil showing the knobs disposed on the partitions as well as the bow-wave effect produced on the skin in the use of the knobs of the invention.
Figure 5:
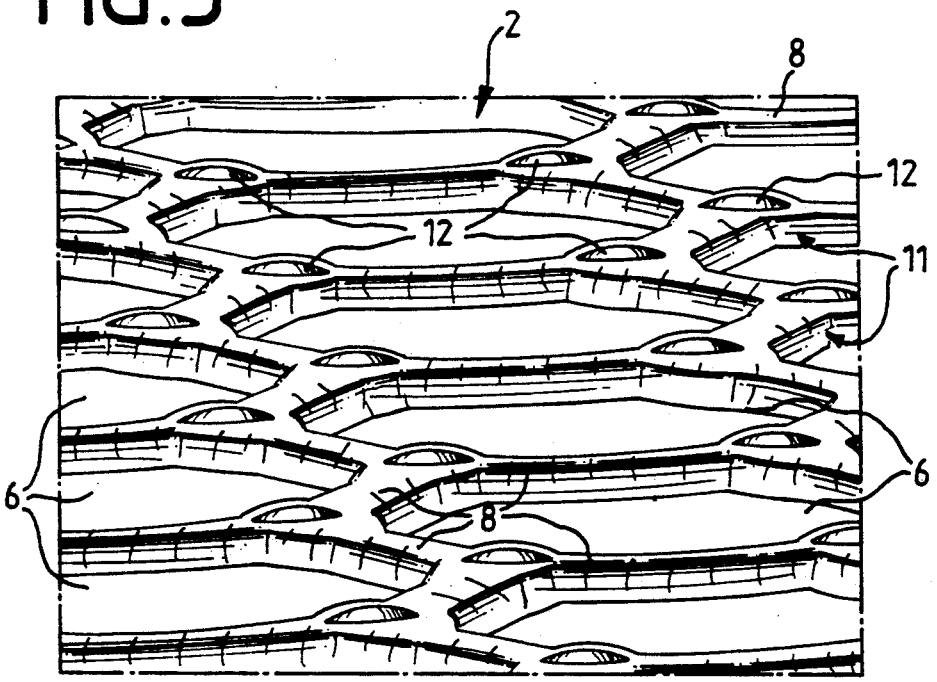
FIG. 5 is a fragmentary view, in perspective, of the shaving foil showing the knobs provided on the skin engaging surface of the shaving foil.
Figure 7:
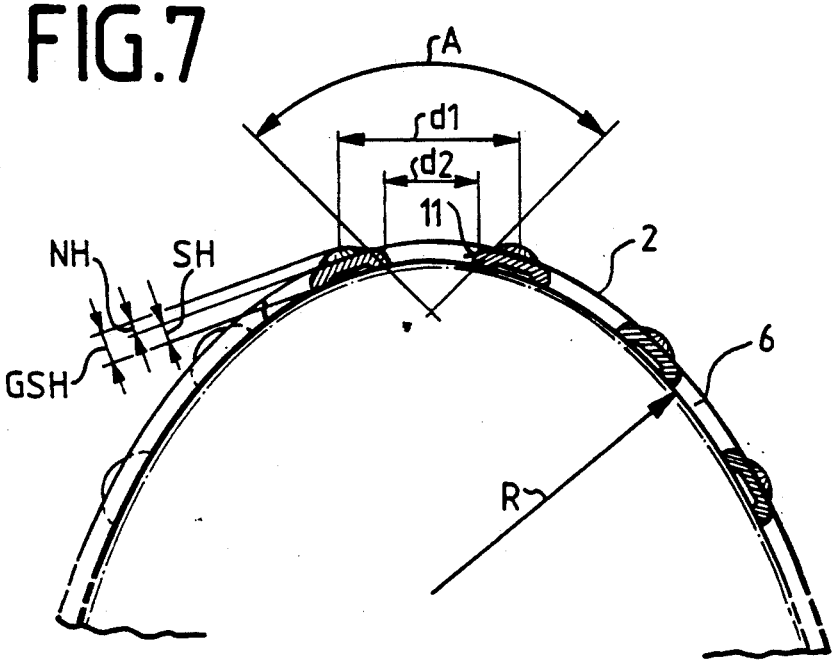
FIG. 7 is a cross-sectional view of the upper domed portion of the shaving foil showing the knobs disposed on the partitions.

As becomes apparent from FIGS. 3, 7 and particularly from FIG. 6, the shaving foil 2 is composed of the partition height SH and the knob height NH of the protuberances or knobs 12 disposed on the partitions 8. Adding NH and SH results in the thickness GSH of the shaving foil:

$$GSH = NH + SH$$

Assuming that a shaving foil without knobs SH has a thickness of, for example 60μ, use of the knobs 12 of the invention enables the shaving foil thickness to be reduced by the amount of the knob height NH.

Example:

Total Foil Thickness Exclusive of Knobs 60μ,

Knob Height 20μ

$$GSH - NH = SH$$

$$60\mu - 20\mu = 40\mu$$

As becomes apparent from FIGS. 4 and 8, the knobs 12 are advantageously disposed in the nodal points 13 of the partitions 8. The nodal point 13 is understood to mean the point in which at least two center lines 3 of two or more partitions 8 intersect.

Figure 9:
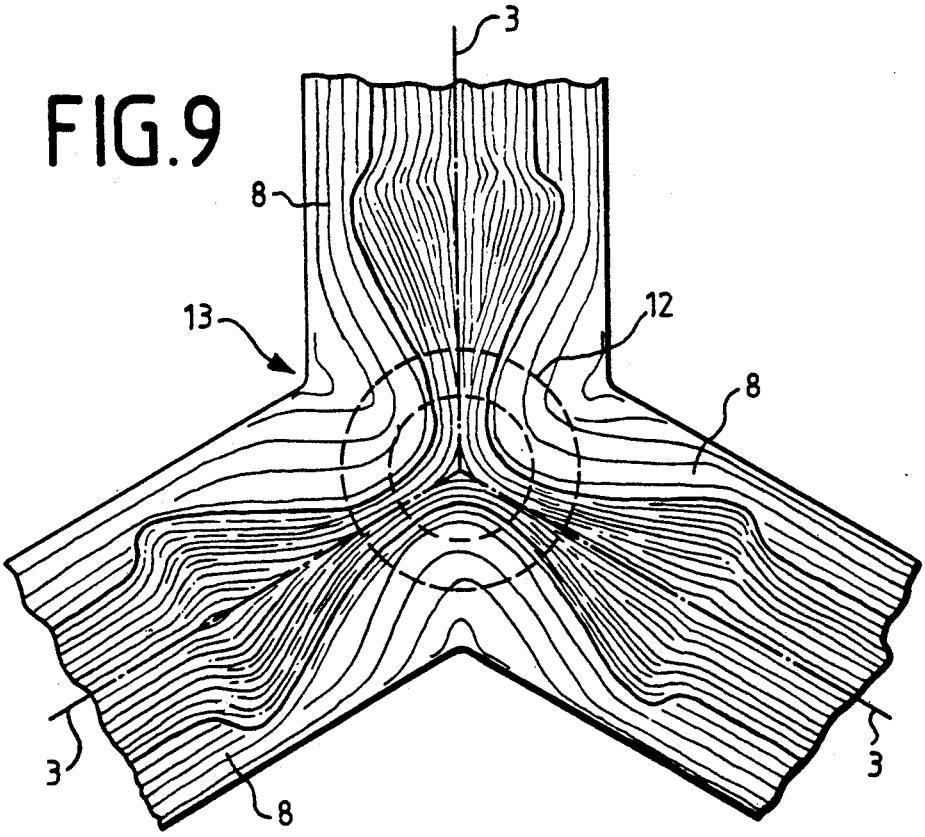
FIG. 9 is a micrograph of a nodal point formed by three converging partitions, showing also the path of the lines of force in this area when a specific type of stress is applied.

As becomes apparent from FIG. 9, it is the nodal point 13 of the partitions 8 which is exposed the most to tensile, compressive, bending and torsional stresses during shaving, so that breaking may occur in particular in the nodal point area if the shaving foil 2 is insufficiently dimensioned. For this reason, the knobs 12 are advantageously provided particularly in the nodal point area of the partitions 8, thus contributing to a reinforcement of the critical areas of the shaving foil 2. This makes it also possible to reduce the conventional partition height SH roughly by the amount of the knob height NH (see FIG. 3).

As becomes apparent from FIG. 4, the knobs 12 are spaced at uniform distances, surrounding each aperture 6 in a circular pattern. Owing to the reinforcement of the partitions 8 by means of the knobs 12 in the area of the nodal points, it is also possible to dimension the aperture 6, that is, the span SW in the shaving foil 2, larger than the aperture of a shaving foil having no knobs—see dashed line. While the partition width remains unchanged, this results in an improved ratio quantity V, that is, the proportion of apertures relative to the partition width is greater. Further, an advantageous side effect thereby achieved is the economy of foil material. Moreover, the lower ends of the protuberances 12 may gradually extend into the side 11 of a partition 8 (see FIG. 3 and FIG. 7).

As becomes apparent from FIG. 6, the knobs 12 have a further advantage in that they contribute substantially to an improved bow-wave effect on the skin. The gliding movement of the knobs 12 over the skin surface stretches it locally, exposing the beard hairs to a greater extent, so that after being received into the aperture 6 they are caught and severed by the blade of the cutter assembly with substantially higher efficiency.

As becomes apparent from FIG. 7, the diameter $d_1$ of the knobs 12 at the upper end is somewhat larger than the diameter $d_2$ of the aperture 6. This results in an approximately tapered widening of the aperture 6. The beard hair pickup operation is thereby facilitated. In FIG. 7, the angle A is 90°. Advantageously, the angle A is between 70° and 100°. According to FIG. 6, the knobs 12 are of a spherical or semispherical shape. They may be shaped in the manner of the frustum of a cone or pyramid.

Further, the knobs 12 may be made of a material other than the remaining part of the shaving foil 2, with the gliding effect of the surface of the knobs 12 then differing from that of the remaining material of the shaving foil 2. For example, the knobs 12 may be manufactured of a galvanoplastic material, thermoplastic plastics, or a ceramic material. This may favorably affect the bow-wave effect produced on the skin.

Still further, at least one further protuberance 12 may be provided on the partitions 8 between the individual protuberances 12 arranged on the nodal points (see in particular FIG. 8).

I claim:

1. A shaving foil for a dry shaving apparatus comprising flexible sheet structure with an array of partition portions that define a plurality of adjacent apertures, each said partition portion separating one aperture from an adjacent aperture and having a center line, said center lines of said partition portions intersecting one another at nodal points, and knob-type protuberances provided on said partition portions at least in the area of said nodal points that separate contiguous ones of said apertures, said protuberances being of thinner material than the material of said partition portions surrounding said apertures.

2. A shaving foil for a dry shaving apparatus comprising flexible sheet structure with an array of partition portions that define a plurality of adjacent apertures, each said partition portion separating one aperture from an adjacent aperture and having a center line, said center lines of said partition portions intersecting one another at nodal points, and knob-type protuberances provided on said partition portions at least in the area of said nodal points that separate contiguous ones of said apertures, and at least one further protuberance provided between the individual protuberances arranged at said nodal points.

3. A shaving foil for a dry shaving apparatus comprising flexible sheet structure with an array of partition portions that define a plurality of adjacent apertures, each said partition portion separating one aperture from an adjacent aperture and having a center line, said center lines of said partition portions intersecting one another at nodal points, and knob-type protuberances provided on said partition portions at least in the area of said nodal points that separate contiguous ones of said apertures, the total open area of each said aperture being greater than one half the total area of said partition portions that surround said aperture.

4. The shaving foil as claimed in claim 3 wherein the widths of said partition portions are smaller than the spans of said apertures, and the heights of said protuberances are equal to or smaller than the heights of said partition portions.

5. The shaving foil as claimed in claim 4 wherein said protuberances are made of the same material as the remaining part of said shaving foil, and said protuberances have lower ends that gradually extend into side regions of said partition portions.

6. The shaving foil as claimed in claim 4 wherein a said protuberance is arranged on each said nodal point of an intersecting ones of said partition portions, and at least one further protuberance is provided between individual protuberances arranged at said nodal points.

7. The shaving foil as claimed in claim 5 wherein said apertures are of hexagonal configuration, the center lines of said partition portions are straight, and said protuberances are of semi-circular shape.

8. The shaving foil as claimed in claim 5 wherein the height of said protuberances is about twenty micrometers.

9. A shaving foil for a dry shaving apparatus comprising flexible sheet structure with an array of partition portions that define a plurality of adjacent apertures, each said partition portion separating one aperture from an adjacent aperture and having a center line, said center lines of said partition portions intersecting one another at nodal points, and knob-type protuberances provided on said partition portions at least in the area of said nodal points that separate contiguous ones of said apertures, said apertures being of hexagonal configuration, the center lines of said partition portions being straight, and said protuberances being of semi-spherical shape.

* * * * *